United States Patent [19]

Mayfield et al.

[11] 4,024,723

[45] May 24, 1977

[54] PLATFORM LEG DIAPHRAGM

[75] Inventors: Windel O. Mayfield; Clarence T. Thomerson; Tom C. Waldrop, all of Corsicana, Tex.

[73] Assignee: Regal Tool & Rubber Co. Inc., Corsicana, Tex.

[22] Filed: June 24, 1976

[21] Appl. No.: 699,322

[52] U.S. Cl. ..... 61/98; 61/100; 166/187

[51] Int. Cl.[2] ..... E02D 5/14

[58] Field of Search ..... 61/98, 88, 87, 94, 102, 61/101, 53.5, 99, 80, 89; 166/116, 187; 277/237

[56] References Cited

UNITED STATES PATENTS

| | | | |
|---|---|---|---|
| 3,533,241 | 10/1970 | Bowerman et al. | 61/535 X |
| 3,868,826 | 3/1975 | Landers | 61/102 |

*Primary Examiner*—Jacob Shapiro

*Attorney, Agent, or Firm*—Richards, Harris & Medlock

[57] ABSTRACT

In an offshore platform to be erected on hollow legs which receive piles driven down through the legs into the ocean floor, a resilient diaphragm closure for each of said legs to prevent ingress of water as said platform is moved into position. The diaphragm includes a ring of down-facing cutter blades oriented in the upper surface of said diaphragm for registration with a down moving end of the piling to sever the diaphragm and facilitate passage of the end of the piling beyond the location of the diaphragm.

10 Claims, 4 Drawing Figures

PLATFORM LEG DIAPHRAGM

FIELD OF THE INVENTION

This invention relates to closure diaphragms for offshore platforms as used in oil well drilling and production, and more particularly to a closure diaphragm including cutter blades.

BACKGROUND OF THE INVENTION

Offshore platforms are generally fabricated in a harbor or on a shore location and are then towed to a marine site where they are tipped on end and lowered so that the legs of the platforms rest on the ocean floor. Traditionally, the legs are hollow structures so that pilings can be driven downwardly through the legs and into subterranean formations below the ocean floor. Generally, the ends of the platform legs are open to permit piling to be driven therethrough. However, when the platforms are placed in position, silt and other debris enter the lower ends of the legs before the pilings are driven therethrough. Since the annulus between the piling and legs is usually filled with cement or grout, it is most desirable to exclude as much foreign material as possible from the legs. It is therefore desired to provide a closure structure for the platform legs and one which will easily sever when the piling is driven through the platform legs.

SUMMARY OF THE INVENTION

In accordance with the present invention, an offshore platform to be erected on hollow legs which receive piles driven down through the legs into the ocean floor has a resilient diaphragm closure for the legs to prevent ingress of water as the platform is moved into position. The diaphragm includes a ring of down-facing cutter blades oriented in the upper surface of the diaphragm for registration with a down moving end of the pilings to sever the diaphragm and facilitate passage of the end of the piling beyond the location of the diaphragm.

DESCRIPTION OF THE DRAWINGS

The novel features believed characteristic of the invention are set forth in the appended claims. The invention itself, however, as well as further objects and advantages thereof, will best be understood by reference to the following detailed description of an illustrative embodiment taken in conjunction with the accompanying drawings, in which:

DESCRIPTION OF THE PREFERRED EMBODIMENT

Figure 1:
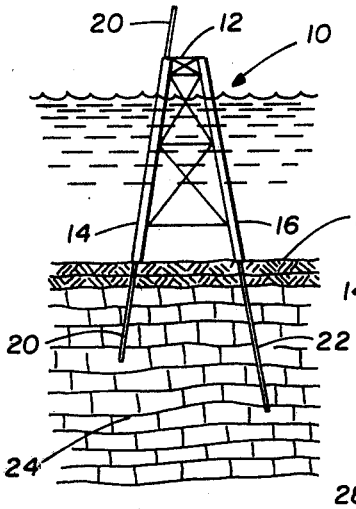
FIG. 1 is an illustration of an offshore installation where pilings are driven through pipe forming portions of an offshore platform structure to anchor the structure.

Referring now to FIG. 1, an offshore platform generally referred to as 10 has been illustrated. Conventionally, a structure 12 having a plurality of depending legs, such as the legs 14 and 16, is fabricated in a harbor or an onshore location and then towed to a marine site where it is tipped on end and lowered so that the ends of legs 14 and 16 rest on the ocean floor 18. Legs 14 and 16 traditionally are hollow structures so that pilings 20 and 22 can be driven downwardly through legs 14 and 16, respectively, and into the subterranean formation 24. In the illustration shown, piling 22 is driven to its total depth whereas piling 20 is still partially exposed above the deck of the offshore platform 10.

The present invention is directed to the control of fluid, particularly prevention of ingress of fluids and debris as a platform is being erected, prior to the placement of the pilings 20. The invention is particularly directed to structure for sealing the lower ends of legs 14 and 16 in a manner that cooperates with the pilings such as to readily be relieved when the pilings are to be driven. In order that the relationship of the present invention to the entire structure may be understood, utilization thereof together with a grout seal of improved character will be described.

Figure 2:
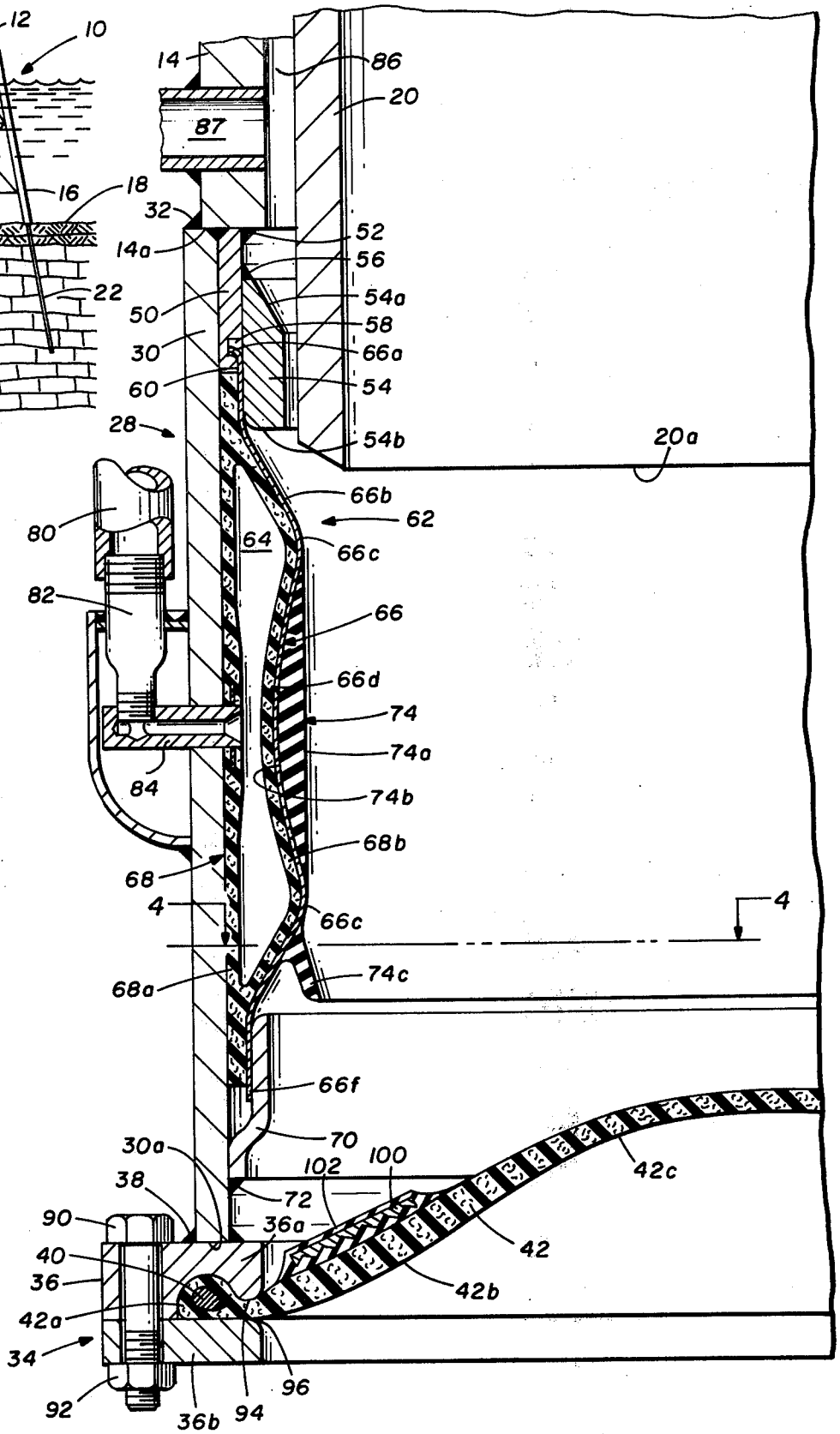
FIG. 2 is a sectional view of the lower portion of a leg of the platform showing the preferred diaphragm in accordance with the present invention.
Figure 3:
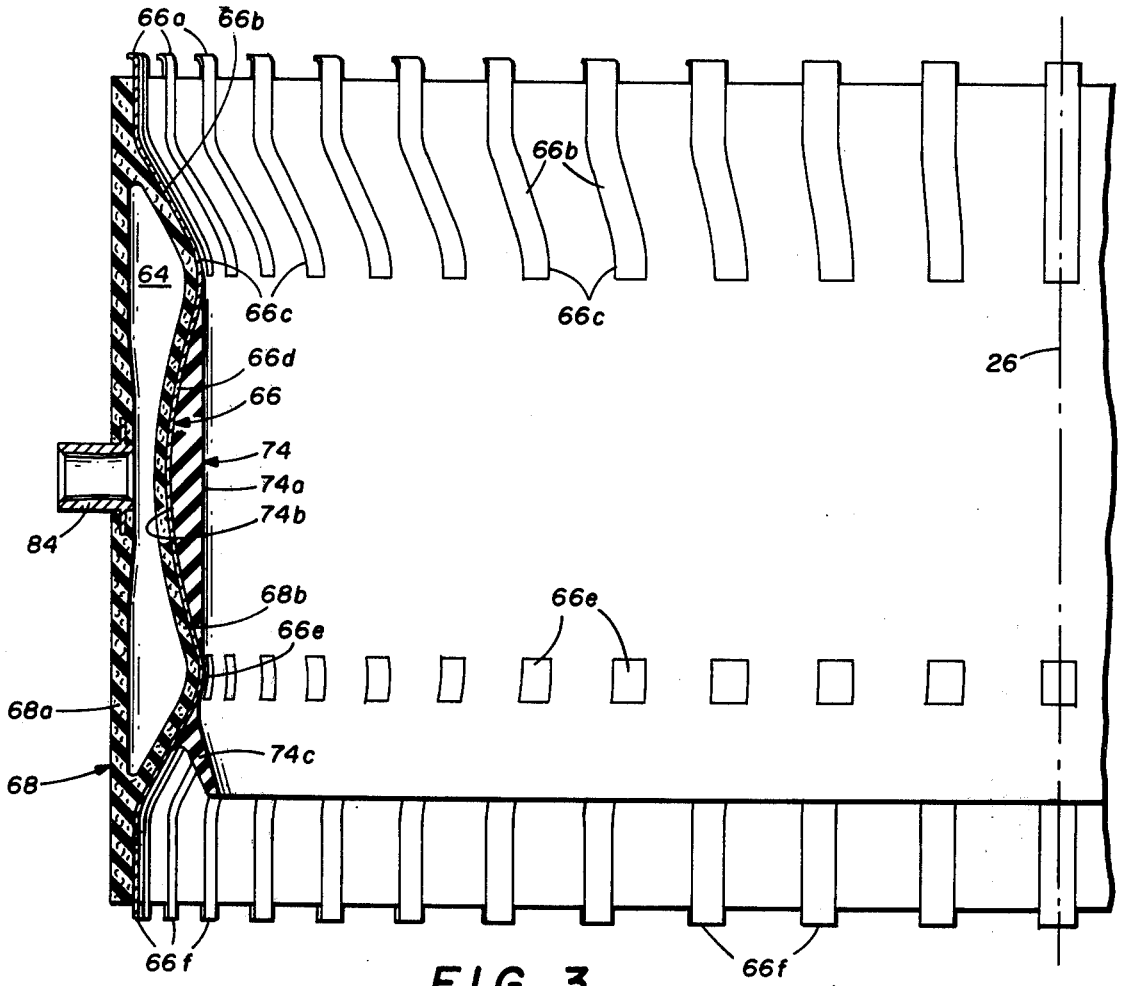
FIG. 3 is a sectional view partially in plan showing the seal of FIG. 2.

A preferred embodiment of the invention is illustrated in FIG. 2, in which the structure comprising the lower end of leg 14 through which piling 20 extends has been illustrated in connection with a grout seal structure. FIG. 2 comprises a sectional view of the lower end of the leg 14 and the piling 20, it being understood that the system is symmetrical about center axis 126 (FIG. 3). As illustrated, the lower end 20a of piling 20 is poised above the sealing structure generally referred to as 28 and is in position to be driven downward below the lower end of sealing structure 28 and into the formations therebelow.

Figure 4:
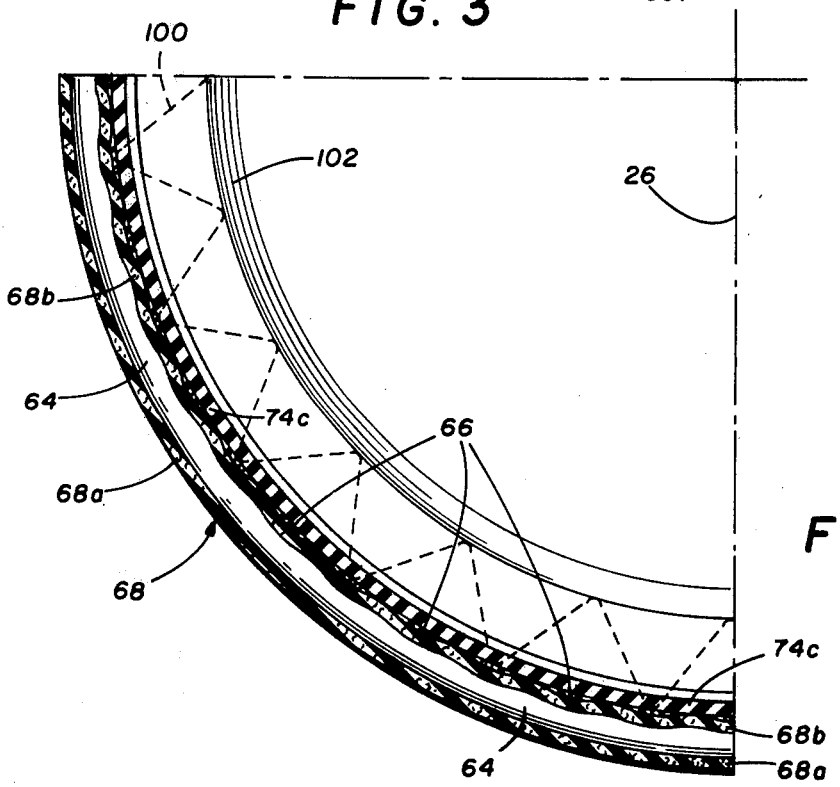
FIG. 4 is a sectional view taken along line 4-4 of FIG. 2.

Referring simultaneously to FIGS. 2, 3 and 4, sealing structure 28 is mounted on the lower end of leg or platform jacket 14 and is designed to permit passage therethrough of piling 20 and to establish a fluid tight seal with the inner wall of leg 14. Leg 14 includes a cylindrical extension 30, which is welded as at 32 to the lower end 14a of leg 14. Cylindrical extension 30 is slightly larger in diameter than leg 14, and has a closure structure generally referred to as 34, which includes a foot clamp 36 welded as at 38 to the lower end **30*a*. Foot clamp 36 comprises a fixed ring 36*a* and a removable ring 36*b*. An annular groove is formed in the lower face of ring 36*a* to receive a ring 40 of a closure diaphragm 42** to be subsequently described.

A cylindrical extension 50 is welded as at 52 to the bottom 14a of leg 14 and has an outside diameter corresponding to the inside diameter of cylindrical extension 30. A guide ring 54 is welded at 56 to the inner surface of cylinder 50 and has an upper beveled surface **54*a* and a lower outer curved perimeter 54*b*. The lower portion of cylinder 50 is provided with an annular groove 58 and a series of short axially extending slots 60. Slots 60 are spaced on the order of two inches apart around the entire perimeter of cylinder 50**.

The grout seal 62 comprises a packer which is inflatable to vary the dimension of an interior annular cavity 64. Grout seal 62 includes an array of flat springs, such as the spring 66 having an upper end **66*a*. Upper end 66*a* of spring 66 is positioned and received by groove 58**.

Spring 66 is molded into a flat cloth reinforced sealing member 68. It will be noted that spring 66 deviates in section **66*b* inwardly away from the wall of cylindrical extension 30 to a crest 66*c* and then deviates back out toward cylindrical extension 30 in the center section 66*d* and again inwardly to crest 66*e* and finally outwardly and downwardly to the end 66*f*. End 66*f* of spring 66 comprises a straight section, which is nested between a retaining ring 70 and the lower margin of 68***a*. Retaining ring 70 is secured by weld 72 to the inner surface of cylindrical extension 30 near the lower end 30*a* thereof and immediately above foot clamp 36.

Sealing member 68 is provided with a continuous annular wall structure including an outer cylindrical body section 68*a* and an inner body section 68*b* that has contours substantially conforming to the contour of the spring 66. A filler section 74 is composed of a resilient material such as rubber or the like and is molded to sealing member 68. Filler section 74 has a cylindrical inner wall 74*a*, and a curved outer wall 74*b* that conforms with the inner surface of spring 66. An initial sealing lip 74*c* is molded to the wall section 74*a* immediately below crown 66*e* of spring 66 and extends downwardly and inwardly therefrom.

A fluid pressure line 80 extending from the surface of offshore platform 10 downwardly along the outer wall of leg 14 is connected by way of a nipple 82 into a subpipe 84. Subpipe 84 leads through the wall of cylindrical extension 30 and is molded integrally with portion 68*a* of sealing member 68 so that fluid pressure may be introduced into annular cavity 64 to expand the same into contact with the outer surface of the piling 20 when piling 20 is extended downwardly through seal 28. Filler section 74 is formed of a homogeneous structure of relatively soft rubber and is without the reinforcement which characterizes the multilayer of fabrics in sealing member 68.

Spring 68 serves the purpose of distributing the load over a relatively long contact area on piling 20 when pressure is applied to the annular cavity 64. Spring 66 serves to enhance the length of the contact area whereas sealing lip 74*c* serves to arrest the flow into the leg 10 of water and debris when the diaphragm 42 is ruptured by passage therethrough of piling 20. In practice, piling 20 is driven through the unit to a desired depth after which grout seal 62 is actuated by application of pressure through line 80 to effect a seal between the outer wall of piling 20 and the filler section 74*a*.

After the piling 20 has been driven to the desired depth, a cement grout is pumped into the annulus 86 so that platform leg 14 and piling 20 are rigidly adhered and form a unitary structure.

It will be recognized that the zone outside the diaphragm 42 is subject to hydrostatic pressure the magnitude of which depends upon the depth of the water at the location being worked. Thus, when grout is pumped into annulus 86 through grout line 87, it is desired that the seal to the outer surface of piling 20 be maintained without interruption. Spring 66 serves to oppose any forces that would tend to extrude the annular cavity 64 in either direction and thus give the annular cavity 64 axial integrity. The lower end 66*f* of spring 66 is slidable behind the retaining ring 70 to accommodate some movement. Upper end 66*a* of spring 66 is nested in groove 58 so that the upper end of annular cavity 64 is fixed whereas the lower end may vary against some relative movement.

As previously stated, the lower end of leg 14 is closed by a closure diaphragm 42, which is composed of a reinforced elastomeric material such as rubber or the like. Referring to FIGS. 2 and 4, closure diaphragm 42 includes ring 40 having a teardrop-shaped cross section. Ring 40 is molded to diaphragm 42 and is retained between the confronting faces of rings 36*a* and 36*b*. The periphery 42a of closure diaphragm 42 is therefore squeezed between rings 36*a* and 36*b*, which are connected by bolt 90 and nut 92. In order to prevent damaging of closure diaphragm 42 upon flexing thereof, it is desirable to chamfer the internal-inner edges 94 and 96 of rings 36*a* and 36*b* respectively.

Closure diaphragm 42 includes a plurality of knife blades such as rule cutter 100, located near the outer periphery of diaphragms 42 at 42*b*. Rule cutter 100 is enclosed by a filler 102 such as rubber or the like, which is molded to the upper surface of closure diaphragm 42 in the area of 42*b*. Closure diaphragm 42 has a variable thickness, being relatively thicker in the area of 42*b* below cutter 100 than in the central portion 42*c*. The variable thickness permits use of less material in the manufacture of closure diaphragm 42, which is characterized by a multilayer fabric reinforced rubber.

In operation, as piling 20 is driven down through leg 14 the lower end 20*a* of piling 20 will engage filler 102 and thrust the rule cutter 100 downwardly through portion 42b of closure diaphragm 42. This downward motion will then sever diaphragm 42 and permit piling 20 to proceed through the bottom end of leg 14 into the subterranean formation 24 (FIG. 1).

In all cases, regardless of the particular structure of the grout seal, the diaphragm is provided with cutters built therein and the peripheral anchor ring secured at the lip of the diaphragm so that the piling directed downwardly through the grout seal will immediately penetrate the diaphragm. The circular contact zone includes knives 100 so that the diaphragm will be readily severed for passage therebelow of the piling.

Having described the invention in connection with certain specific embodiments thereof, it is to be understood that further modifications may now suggest themselves to those skilled in the art and it is intended to cover such modifications as fall within the scope of the appended claims.

What is claimed is:

1. In an offshore platform to be erected on hollow legs which receive piles driven through said legs into the ocean floor, the combination which comprises:

a. a resilient diaphragm closing each of said legs to prevent ingress of water as said platform is moved into position; and b. a ring of down facing cutter blades oriented in the upper surface of said diaphragm for registration with a down moving end of said piling to sever said diaphragm and facilitate passage of the end of said piling beyond the location of said diaphragm.

2. The combination of claim 1 and further including:

a. an annular reinforcing element molded in the periphery of said resilient diaphragm and having a teardrop cross sectional shape; and b. said peripheral portion of said diaphragm completely surrounding said annular reinforcing element without reducing the thickness of the material of said diaphragm whereby said diaphragm periphery is enlarged and of substantially circular cross sectional shape.

3. The combination of claim 2 and further including:

a. upper and lower complementary annular rings for mounting said diaphragm on the lower end of said legs;

b. means for fastening together said annular mounting rings at their external periphery portions;

c. said upper mounting ring having an annular groove of semicircular cross sectional shape;

d. said annular groove being of slightly less radial diameter than said diaphragm periphery for retaining and squeezing said periphery when said mounting rings are secured in an abutting relationship; and e. means for securing said upper mounting ring to the lower end of said leg.

4. The combination of claim 3 wherein the inner edges of said mounting rings are chamfered.

5. The combination of claim 1 wherein said resilient diaphragm comprises fiber reinforced rubber having a greater thickness in the area of said down facing cutter blade than at its interior.

6. The combination of claim 1 and further including a packer assembly interposed between said diaphragm and said leg for sealing off around said piling driven through said leg so as to support grout introduced into the annulus between said piling and said leg.

7. In an offshore platform to be erected on hollow legs which receive piles driven down through said legs into the ocean floor, a rupturable seal assembly for closing the bore of said legs including:

a. a resilient diaphragm of reinforced elastomeric material and of variable thickness;

b. a ring of down facing cutter blades oriented in the upper surface of said diaphragm for registration with a down moving end of said piling to sever said diaphragm and facilitate passage of the end of said piling beyond the location of said diaphragm;

c. said diaphragm being relatively thicker in the area of said cutter blades than at its interior;

d. an annular reinforcing element molded in the periphery of said resilient diaphragm and having a teardrop cross sectional shape;

e. the peripheral portion of said diaphragm completely surrounding said annular reinforcing element without reducing the thickness of the material of said diaphragm whereby said diaphragm periphery is enlarged and of substantially circular cross sectional shape; and f. means for mounting said diaphragm on the lower end of said legs.

8. The seal assembly of claim 7 wherein said resilient diaphragm comprises fiber reinforced rubber.

9. The seal assembly of claim 7 wherein said down facing cutter blades comprise a rule cutter.

10. The seal assembly of claim 7 and further including a packer assembly interposed between said diaphragm and said leg for sealing off around said piling driven through said leg so as to support grout introduced into the annulus between said piling and said legs.

* * * * *